US009383677B2

(12) United States Patent
Lee et al.

(10) Patent No.: US 9,383,677 B2
(45) Date of Patent: Jul. 5, 2016

(54) IMAGE FORMING APPARATUS AND CONTROL METHOD FOR THE SAME

(71) Applicant: Samsung Electronics Co., Ltd., Suwon-si (KR)

(72) Inventors: Jun Hee Lee, Suwon-si (KR); Byeong No Jeong, Suwon-si (KR); Jong Won Han, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/064,365

(22) Filed: Oct. 28, 2013

(65) Prior Publication Data

US 2014/0119758 A1 May 1, 2014

(30) Foreign Application Priority Data

Oct. 30, 2012 (KR) ..... 10-2012-0120965

(51) Int. Cl.
*G03G 15/06* (2006.01)
*G03G 15/08* (2006.01)
*G03G 15/00* (2006.01)

(52) U.S. Cl.
CPC ..... *G03G 15/0812* (2013.01); *G03G 15/55* (2013.01); *G03G 15/065* (2013.01)

(58) Field of Classification Search
CPC ..... G03G 15/065; G03G 15/0812
USPC ..... 399/55, 274, 284
See application file for complete search history.

(56) References Cited

U.S. PATENT DOCUMENTS

| | | | | |
|---|---|---|---|---|
| 6,125,245 | A * | 9/2000 | Shibuya | G03G 15/0131 399/49 |
| 2003/0058251 | A1* | 3/2003 | Nakayama | H04N 1/00002 345/589 |
| 2005/0158061 | A1* | 7/2005 | Do | G03G 15/0848 399/44 |
| 2009/0003868 | A1* | 1/2009 | Namiki et al. | 399/69 |
| 2010/0061749 | A1* | 3/2010 | Hagiwara et al. | 399/55 |
| 2010/0247128 | A1* | 9/2010 | Sakata | 399/53 |

* cited by examiner

*Primary Examiner* — David Gray
*Assistant Examiner* — Thomas Giampaolo, II
(74) *Attorney, Agent, or Firm* — Staas & Halsey LLP

(57) ABSTRACT

An image forming apparatus and a control method for the same, which ensure acquisition of a high-quality image by controlling physical-states of toner on a developer roller based on sensed variation in states of internal components of a developer cartridge, and which enable sensing and determination of the lifespan of the developer cartridge, is provided. The control method for the image forming apparatus includes applying a current detection bias to a developer roller blade of a developer cartridge, detecting the magnitude of current of the developer roller blade when the current detection bias is applied to the developer roller blade, and variably controlling a developer cartridge bias to be applied to the developer cartridge for image formation based on the detected magnitude of current of the developer roller blade, so as to allow a target magnitude of constant current to flow through the developer roller blade during image formation.

16 Claims, 9 Drawing Sheets

FIG. 2A

| | DR | | DR Blade | | SR | | Q/A ($\mu C/cm^2$) | M/A ($mg/cm^2$) | Q/M |
|---|---|---|---|---|---|---|---|---|---|
| NUMBER OF SHEETS PRINTED | VOLTAGE[V] | CURRENT [μA] | VOLTAGE[V] | CURRENT [μA] | VOLTAGE[V] | CURRENT [μA] | | | |
| 0 | -329 | 13 | -374 | -6 | -471 | -3.9 | 0.0164 | 0.59 | 27.8 |
| 3k | -329 | 5.9 | -382 | -4.2 | -479 | -1.2 | 0.0163 | 0.75 | 21.7 |
| 15k | -329 | 4.8 | -382 | -3.4 | -479 | -0.8 | 0.0115 | 0.7 | 16.4 |
| 21k | -329 | 4 | -381 | -2.2 | -478 | -0.6 | 0.0142 | 0.73 | 19.5 |

FIG. 2B

| | DR | | DR Blade | | SR | | Q/A ($\mu C/cm^2$) | M/A ($mg/cm^2$) | Q/M |
|---|---|---|---|---|---|---|---|---|---|
| NUMBER OF SHEETS PRINTED | VOLTAGE[V] | CURRENT [μA] | VOLTAGE[V] | CURRENT [μA] | VOLTAGE[V] | CURRENT [μA] | | | |
| 0 | -319 | 6.2 | -370 | -4.3 | -465 | -11.5 | 0.0181 | 0.58 | 31.2 |
| 6k | -319 | 4 | -371 | -3.3 | -465 | 0.15 | 0.0183 | 0.66 | 27.7 |
| 12k | -319 | 3.4 | -371 | -3 | -466 | 0.12 | 0.0155 | 0.7 | 22.1 |
| 18k | -319 | 2.4 | -371 | -2 | -466 | 0.04 | 0.0124 | 0.74 | 16.8 |
| 21k | -319 | 2.2 | -371 | -1.8 | -466 | 0.1 | 0.0094 | 0.75 | 12.5 |

FIG. 4

| MEASURED VALUE - REFERENCE VALUE | VOLTAGE COMPENSATION | PWM COMPENSATION |
|---|---|---|
| ⋮ | -90V | -3 |
| -14 | -90V | -3 |
| -13 | -90V | -3 |
| -12 | -90V | -3 |
| -11 | -60V | -2 |
| -10 | -60V | -2 |
| -9 | -60V | -2 |
| -8 | -60V | -2 |
| -7 | -30V | -1 |
| -6 | -30V | -1 |
| -5 | -30V | -1 |
| -4 | -30V | -1 |
| -3 | 0V | 0 |
| -2 | 0V | 0 |
| -1 | 0V | 0 |
| 0 | 0V | 0 |
| +1 | 0V | 0 |
| +2 | 0V | 0 |
| +3 | 0V | 0 |
| +4 | +30V | +1 |
| +5 | +30V | +1 |
| +6 | +30V | +1 |
| +7 | +30V | +1 |
| +8 | +60V | +2 |

FIG. 6

| BIAS LEVEL | REPRESENTATIVE VALUE | DETERMINATION INDEX |
|---|---|---|
| 66 | 0 | 0 |
| 66 | 23 | 1 |
| 66 | 46 | 2 |
| 66 | 75 | 3 |
| 66 | 95 | 4 |
| 66 | 113 | 5 |
| 66 | 129 | 6 |
| 66 | 143 | 7 |
| 71 | 121 | 7 |
| 71 | 132 | 8 |
| 71 | 142 | 9 |
| 71 | 151 | 10 |
| 71 | 159 | 11 |
| 71 | 166 | 12 |
| 71 | 172 | 13 |
| 71 | 172 | 13 |
| 83 | 140 | 14 |
| 83 | 149 | 15 |
| 83 | 157 | 16 |
| 83 | 163 | 17 |
| 83 | 171 | 18 |
| 83 | 177 | 19 |
| 83 | 182 | 20 |
| 83 | 186 | 21 |
| ⋮ | ⋮ | ⋮ |

(A)

(B)

IMAGE FORMING APPARATUS AND CONTROL METHOD FOR THE SAME

CROSS-REFERENCE TO RELATED APPLICATIONS

This application claims the priority benefit of Korean Patent Applications No. 10-2012-0120965, filed on Oct. 30, 2012 in the Korean Intellectual Property Office, the disclosure of which is incorporated herein by reference.

BACKGROUND

1. Field

Embodiments relate to an image forming apparatus having a developer roller blade to control toner amount and charge quantity of a developer roller included in a developer cartridge.

2. Description of the Related Art

An image forming apparatus forms a toner image by forming an electrostatic latent image on a photoconductor with a potential difference and supplying toner as developer stored in a developer cartridge to the electrostatic latent image. The developer cartridge is provided with a developer roller that is rotated in response to rotation of the photoconductor and has a constant potential energy. The toner attached to the developer roller is delivered to the electrostatic latent image of the photoconductor by a potential difference between the developer roller and the photoconductor.

The image forming apparatus may charge the toner with a uniform charge. Conventionally, the image forming apparatus is equipped with a developer roller blade to apply pressure to the developer roller, which ensures uniform charge of the toner to be attached to the developer roller and enables control of toner amount M and charge quantity Q.

With regard to control of toner amount M and charge quantity Q, conventionally, the developer roller blade has been controlled in terms of a constant-voltage. In addition, conventionally, non-sensing prediction control using only the lifespan of the image forming apparatus and surrounding environment information (e.g., temperature and humidity) has been adopted, and thus no sensing devices to detect states of components inside the developer cartridge have been utilized.

SUMMARY

In an aspect of one or more embodiments, there is provided an apparatus and method to acquire a high-quality image by controlling physical-states (toner amount and charge quantity) of toner on a developer roller based on sensed variation in states of internal components of a developer cartridge, such as the developer roller, a developer roller blade and a supply roller, etc.

In an aspect of one or more embodiments, there is provided an apparatus and method to sense and determine the lifespan of a developer cartridge.

In an aspect of one or more embodiments, there is provided an apparatus and method to sense abnormalities of a developer cartridge.

In an aspect of one or more embodiments, there is provided a control method for an image forming apparatus which includes applying a current detection bias to a developer roller blade of a developer cartridge, detecting the magnitude of current flowing through the developer roller blade when the current detection bias is applied to the developer roller blade, and variably controlling a developer cartridge bias to be applied to the developer cartridge for image formation based on the detected magnitude of current of the developer roller blade, so as to allow a target magnitude of constant current to flow through the developer roller blade during image formation.

The magnitude of current flowing through the developer roller blade may be detected while the current detection bias is applied to the developer roller blade for a preset time, and the current detection may be performed at each of a plurality of trigger times to acquire a plurality of current values, and the average of the plurality of current values may be utilized as a representative value of the magnitude of current of the developer roller blade.

The magnitude of current detected for a predetermined first part of the preset time may be neglected, and only the magnitude of current detected for the last part of the preset time may be utilized.

The magnitude of current detection bias may be determined with reference to a previously stored current detection bias table that defines a relationship between a current detection bias level, a representative current value corresponding to the current detection bias level, and a determination index.

The control method may further include converting the magnitude of current flowing through the developer roller blade into an analog voltage signal via a current-to-voltage converter, converting the analog voltage signal provided by the current-to-voltage converter into a digital signal via an analog-to-digital converter, generating an Analog-to-Digital Conversion (ADC) index from the voltage signal digitized by the analog-to-digital converter so as to provide the ADC index to a controller via a data converter, generating a high voltage control signal having a pulse width corresponding to a Pulse Width Modulation (PWM) index via a pulse width modulator if the controller generates the PWM index with reference to the ADC index provided by the data converter, and generating a high voltage corresponding to the pulse width of the high voltage control signal provided by the pulse width modulator so as to output the high voltage as a developer cartridge bias via a high voltage generator.

The generation of the PWM index may include subtracting a preset reference value from a measured value representing the detected magnitude of current of the developer roller blade, acquiring a voltage compensation corresponding to the subtraction result, and calculating a PWM compensation corresponding to the voltage compensation to generate the PWM index.

The control method may further include generating the PWM index if the ADC index is equal to or greater than a preset value, thereby controlling application of the developer bias.

The control method may further include determining that the lifespan of the developer cartridge has expired if the ADC index is less than the preset value, thereby controlling output of a lifespan expiration notification.

The control method may further include determining that the developer cartridge malfunctions if the ADC index exceeds a preset upper limit, thereby controlling output of an error notification.

In an aspect of one or more embodiments, there is provided an image forming apparatus which includes a developer cartridge including a developer roller blade, a high voltage power supply unit to apply a current detection bias and a developer cartridge bias to the developer roller blade, and a controller that detects the magnitude of current flowing through the developer roller blade when the current detection bias is applied to the developer roller blade, and variably controls a developer cartridge bias to be applied to the developer cartridge for image formation based on the detected magnitude of current of the developer roller blade, so as to allow a target magnitude of constant current to flow through the developer roller blade during image formation.

The controller may detect the magnitude of current flowing through the developer roller blade while the current detection bias is applied to the developer roller blade for a preset time, and the controller may acquire a plurality of current values by performing current detection at each of a plurality of trigger times, and utilize the average of the plurality of current values as a representative value of the magnitude of current of the developer roller blade.

The controller may neglect the magnitude of current detected for a predetermined first part of the preset time, and utilize only the magnitude of current detected for the last part of the preset time.

The magnitude of current detection bias may be determined with reference to a previously stored current detection bias table that defines a relationship between a current detection bias level, a representative current value corresponding to the current detection bias level, and a determination index.

The image forming apparatus may further include a current-to-voltage converter that converts the magnitude of current applied to the developer roller blade into an analog voltage signal, an analog-to-digital converter that converts the analog voltage signal provided by the current-to-voltage converter into a digital signal, a data converter that generates an Analog-to-Digital Conversion (ADC) index from the voltage signal digitized by the analog-to-digital converter, and provides the ADC index to the controller, a pulse width modulator that generates a high voltage control signal having a pulse width corresponding to a Pulse Width Modulation (PWM) index if the controller generates the PWM index with reference to the ADC index provided by the data converter, and a high voltage generator that generates a high voltage corresponding to the pulse width of the high voltage control signal provided by the pulse width modulator, and outputs the high voltage as a developer cartridge bias.

The generation of the PWM index may include subtracting a preset reference value from a measured value representing the detected magnitude of current of the developer roller blade, acquiring a voltage compensation corresponding to the subtraction result, and calculating a PWM compensation corresponding to the voltage compensation to generate the PWM index.

The controller may generate the PWM index if the ADC index is equal to or greater than a preset value, thereby controlling application of the developer cartridge bias.

The controller may determine that the lifespan of the developer cartridge has expired if the ADC index is less than the preset value, thereby controlling output of a lifespan expiration notification.

The controller may determine that the developer cartridge malfunctions if the ADC index exceeds a preset upper limit, thereby controlling output of an error notification.

In an aspect of one or more embodiments, there is provided an image forming apparatus which includes a developer cartridge including a developer roller blade; a high voltage power supply unit to apply a current detection bias to the developer roller blade; and a controller that detects the magnitude of current flowing through the developer roller blade when the current detection bias is applied to the developer roller blade, and variably controls a developer cartridge bias to be applied to the developer cartridge for image formation based on the detected magnitude of current of the developer roller blade, so as to allow a target magnitude of constant current to flow through the developer roller blade during image formation.

BRIEF DESCRIPTION OF THE DRAWINGS

These and/or other aspects will become apparent and more readily appreciated from the following description of embodiments, taken in conjunction with the accompanying drawings of which:

FIGS. 2A and 2B are views showing electric properties of a developer cartridge shown in FIG. 1;

FIG. 4 is a view showing a table for compensation of developer cartridge bias;

FIG. 6 is a view showing a table for current detection bias of the image forming apparatus according to an embodiment;

DETAILED DESCRIPTION

Figure 1:
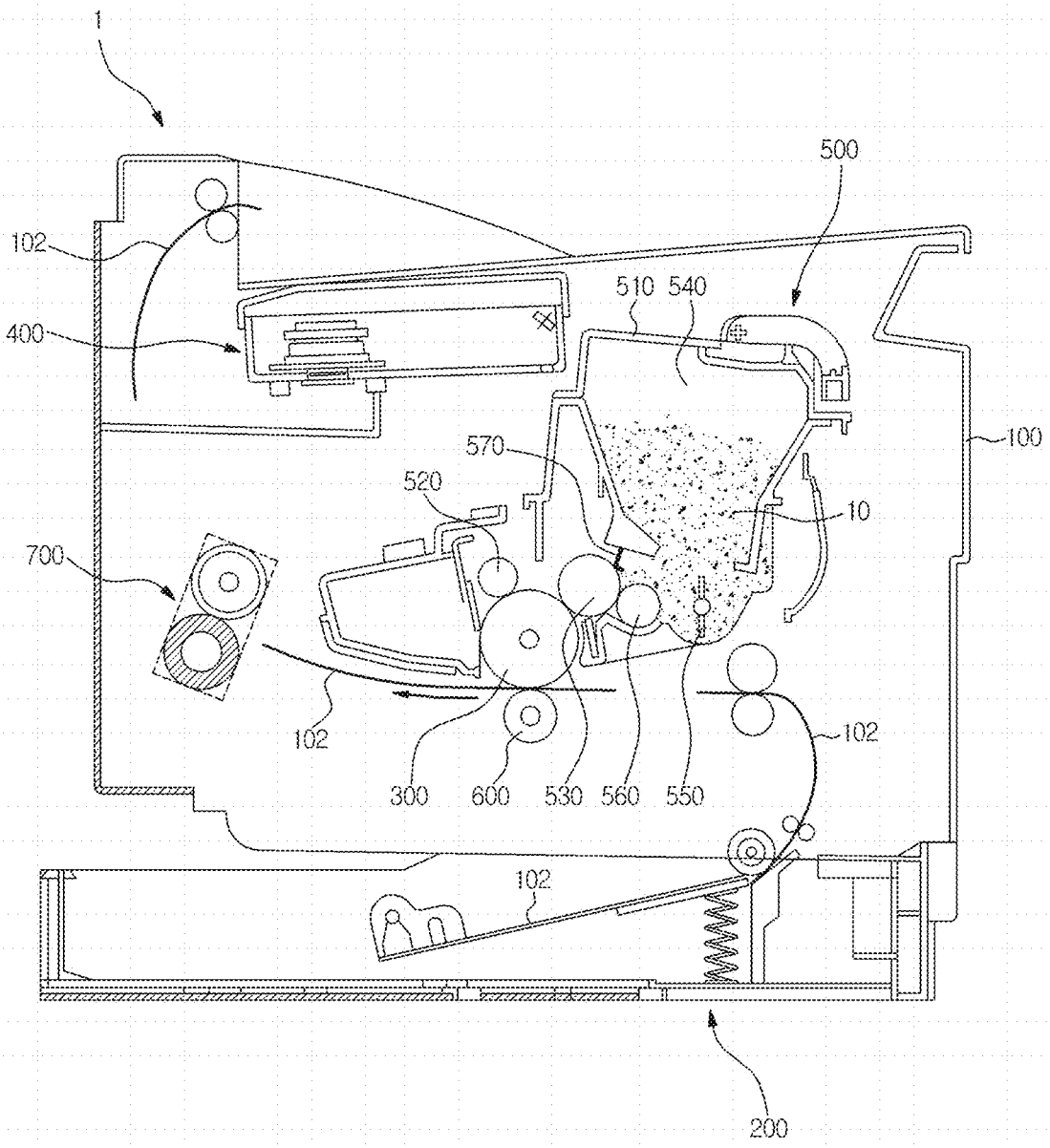
FIG. 1 is a view showing an image forming apparatus according to an embodiment.

Reference will now be made in detail to embodiments, examples of which are illustrated in the accompanying drawings, wherein like reference numerals refer to like elements throughout.

FIG. 1 is a view showing an image forming apparatus according to an embodiment. As exemplarily shown in FIG. 1, the image forming apparatus 1 according to an embodiment includes a main body case 100, a paper feed unit 200, a photoconductor 300, a light scanning unit 400, a developer cartridge 500, a transfer roller 600, and a fixing unit 700.

The main body case 100 defines an outer appearance of the image forming apparatus 1. The paper feed unit 200 is placed inside the main body case 100 and accommodates a stack of paper 102 therein.

The photoconductor 300 takes the form of a cylindrical drum having a predetermined length corresponding to the width of paper 102. The photoconductor 300 is charged to a constant potential energy by a charge roller 520 that will be described hereinafter. The photoconductor 300, an outer circumferential surface of which has uniformly been charged, allows an electrostatic latent image to be formed on the photoconductor 300 by a potential difference when the light scanning unit 400 emits beams to the photoconductor 300. Toner 10 is supplied to the electrostatic latent image by a developer roller 530 that will be described hereinafter, and an image formed by the toner 10 is transferred to the paper 102 passing between the photoconductor 300 and the transfer roller 600.

The light scanning unit 400 emits beams, corresponding to data on an image to be formed on the paper 102, to the photoconductor 300, to form the electrostatic latent image on the photoconductor 300. The light scanning unit 400 may include a laser scanning unit using a laser diode power source, although various other light sources may substitute for the light scanning unit 400.

The developer cartridge 500 supplies the toner 10 as developer to the electrostatic latent image of the photoconductor 300. The developer cartridge 500 includes a cartridge case 510, the charge roller 520, the developer roller 530, a toner reservoir 540, a hopper 550, a supply roller 560, and a developer roller blade 570. The charge roller 520 is rotated in contact with the photoconductor 300 to charge the surface of the photoconductor 300 to a constant potential energy. The developer roller 530 supplies the toner 10 to the electrostatic latent image formed on the photoconductor 300. The toner reservoir 540 is defined in the cartridge case 510 to store the toner 10 therein. The hopper 550 and the supply roller 560 are provided at the toner reservoir 540 to supply the toner 10 to the developer roller 530. The developer roller blade 570 protrudes from the toner reservoir 540 so as to come into contact with the developer roller 530. The charge roller 520 is located inside the cartridge case 510 and is rotated in contact with the photoconductor 300. A charge roller bias is applied to the charge roller 520 and the charge roller 520 charges the outer circumferential surface of the photoconductor 300 to a constant potential energy. If the light scanning unit 400 emits beams to the photoconductor 300 charged to a constant potential energy by the charge roller 520, beam spots on the photoconductor 300 undergo potential variation. This causes a potential difference between the beam spots and the remaining region of the photoconductor 300, whereby the electrostatic latent image is formed on the photoconductor 300 by the potential difference. The developer roller 530 is arranged close to the toner reservoir 540 and is rotated in a direction opposite to a rotation direction of the photoconductor 300. The developer roller 530, to which a developer roller bias is applied, is rotated in contact with the supply roller 560, and the toner 10 fed from the supply roller 560 is attached to the developer roller 530 by a potential difference between the developer roller 530 and the supply roller 560. As the developer roller 530 having the toner 10 attached thereto is rotated in contact with the photoconductor 300, the attached toner 10 is fed to the electrostatic latent image of the photoconductor 300. The toner reservoir 540 defines a storage space for the toner 10 within the cartridge case 510. The toner reservoir 540 has an opening toward the developer roller 530 such that the toner 10 stored in the toner reservoir 540 is fed to the developer roller 530 via the supply roller 560 and the at least one hopper 550 provided at the toner reservoir 540. The hopper 550 is rotatable in the toner reservoir 540 and serves not only to deliver the toner 10 to the supply roller 560, but also to agitate the toner 10, which prevents solidification of the toner 10 and improves fluidity of the toner 10. In addition, the hopper 550 contributes to charge of the toner 10 to a predetermined potential energy by agitating the toner 10. The supply roller 560 is located near one side of the toner reservoir 540, more particularly, below an upper wall of the toner reservoir 540, so as to be rotated in contact with the developer roller 530. The supply roller 560 supplies the toner 10 delivered by the hopper 550 to the developer roller 530. The supply roller 560 and the developer roller 530 are rotated toward each other, i.e. in opposite directions. As such, the toner 10, which receives friction while passing between the supply roller 560 and the developer roller 530, is charged to a constant potential energy and simultaneously, attached to the developer roller 530 in an appropriate amount. The developer roller blade 570 protrudes from the upper wall and comes into contact with the developer roller 530 with a pressure applied therebetween. As such, the developer roller blade 570 ensures uniformity in the amount of the toner 10 that has been fed from the supply roller 560 and attached to the developer roller 530, i.e. uniformity in the mass of the toner 10 per unit area (M/A) [g/cm$^2$] of the developer roller 530. In addition, the developer roller blade 570 charges the toner 10 attached to the developer roller 530 to a predetermined potential energy. The developer roller blade 570 may be formed of a conductive material so as to have a constant potential energy upon receiving power.

The transfer roller 600 is rotated in contact with the photoconductor 300 and transfers an image formed by the toner 10 to the paper 102. The fixing unit 700 fixes the image formed by the toner 10 to the paper 102.

The toner 10 may be classified into two-component toner, magnetic one-component toner, and non-magnetic one-component toner according to a developing method of the image forming apparatus 1. In an embodiment, the toner 10 utilized in the image forming apparatus 1 is non-magnetic one-component toner, 90% or more of which is resin that regulates a basic charge quantity or determines a fixing temperature. Other additives include carbon that determines polarity and color, wax that is an external additive to improve fluidity, and silica that improves hydrophobicity and fluidity, for example. The toner 10 has fluidity in a dry state owing to the aforementioned components and is charged to a constant potential energy under influence of friction.

The supply roller 560, the developer roller 530, the developer roller blade 570, the charge roller 520, the photoconductor 300, and the transfer roller 600 as exemplarily shown in FIG. 1 are biased to cause a voltage difference therebetween. Each of the supply roller 560, the developer roller 530, the developer roller blade 570, the charge roller 520, the photoconductor 300, and the transfer roller 600 may be independently biased. Alternatively, each of the supply roller 560, the developer roller 530, the developer roller blade 570, the charge roller 520, the photoconductor 300, and the transfer roller 600 may be provided with a Zener diode to maintain a constant voltage difference therebetween. In addition, each of the supply roller 560, the developer roller 530, the developer roller blade 570, the charge roller 520, the photoconductor 300, and the transfer roller 600 may be independently provided with a variable-control voltage supply device (e.g., a Pulse Width Modulation (PWM) device). The magnitude of voltage applied to each of the supply roller 560, the developer roller 530, the developer roller blade 570, the charge roller 520, the photoconductor 300, and the transfer roller 600 may be variably controlled based on information regarding surrounding environment and lifespan of the image forming apparatus 1. Variable control of the magnitude of voltage applied to each of the supply roller 560, the developer roller 530, the developer roller blade 570, the charge roller 520, the photoconductor 300, and the transfer roller 600 serves to adjust the concentration of toner to an appropriate level. Adjusting the concentration of toner to an appropriate level is directly related to the quality of an image formed on paper. This is because a high quality image may be acquired only when an appropriate concentration of toner is maintained in every image forming area of paper. To maintain the appropriate concentration of toner, it may be necessary to variably control the magnitude of voltage applied to each of the supply roller 560, the developer roller 530, the developer roller blade 570, the charge roller 520, the photoconductor 300, and the transfer roller 600. (560)(530), (570) (500) Biases applied to components of the developer cartridge 500, including the supply roller 560, the developer roller 530 and the developer roller blade 570, are commonly referred to as a developer cartridge bias.

FIGS. 2A and 2B are views showing electric properties of the developer cartridge shown in FIG. 1. FIG. 2A shows variation in electric properties of the developer cartridge 500 and properties of toner under a high-temperature and high-humidity environment, and FIG. 2B shows variation in electric properties of the developer cartridge 500 and properties of toner under a low-temperature and low-humidity environment. In FIGS. 2A and 2B, "DR" denotes the developer roller 530, "DR Blade" denotes the developer roller blade 570, "SR" denotes the supply roller 560, "Q/A" denotes charge quantity per unit area, "WA" denotes toner amount per unit area, and "Q/M" denotes a ratio of charge quantity to toner amount.

The most important factors with regard to adjustment in the concentration of toner include the supply roller 560, the developer roller 530, and the developer roller blade 570. Among these components, the developer roller blade 570 is a representative factor of adjusting toner amount M and charge quantity Q on a surface of the developer roller 530. The developer roller blade 570 performs control (adjustment) of toner amount via fixed-control using mechanical parameters, such as nip pressure, contact angle, and surplus free length as well as variable-control using electric adjustment of voltage applied. The voltage variable control accomplishes variable control of toner amount M and charge quantity Q using electric force depending on a voltage difference at a contact region between the developer roller 530 and the developer roller blade 570.

As will be appreciated from FIGS. 2A and 2B, toner amount per unit area (M/A) and charge quantity per unit area (Q/A) are increased as a voltage difference between the developer roller 530 and the developer roller blade 570 is increased. Conversely, toner amount per unit area (M/A) and charge quantity per unit area (Q/A) is reduced as a voltage difference between the developer roller 530 and the developer roller blade 570 is reduced.

Toner amount per unit area (M/A) and charge quantity per unit area (Q/A) may vary according to the lifespan of the image forming apparatus 1. The lifespan of the image forming apparatus 1 may be represented by a numerical value corresponding to the accumulated number of sheets printed. Charge quantity per unit area (Q/A) is reduced and toner amount per unit area (M/A) is increased as the accumulated number of sheets printed increases, due to deterioration and aging of the developer cartridge 500. In particular, peel-off of toner may occur due to continuous friction and fluidity, which results in deterioration in the charge performance of toner. In addition, variation in the surface properties and resistance of the developer roller 300 affects M/A and Q/A of toner.

As will be appreciated by comparing FIG. 2A with FIG. 2B, charge quantity Q and toner amount M are sensitive to environmental deviation, and a low-temperature and low-humidity environment generally induces a higher charge quantity per unit area (Q/A) and a lower toner amount per unit area (M/A), and consequently a higher ratio of charge quantity to toner amount (Q/M) than in a high-temperature and high-humidity environment.

Variation in charge quantity Q and toner amount M directly affects image quality, and this effect increases in the course of the lifespan of the image forming apparatus 1. For example, a concentration deviation of toner is increased toward the last part of the lifespan of the image forming apparatus 1, which increases the amount of waste toner and the frequency of background phenomenon. The background phenomenon refers to phenomenon in which a toner image is formed in an area that normally does not permit formation of an image and readily occurs when charge quantity of toner exhibits a high distribution deviation, or when charge quantity of toner is less than an appropriate level.

As exemplarily shown in FIGS. 2A and 2B, it will be appreciated that the supply roller 560, the developer roller 530, and the developer roller blade 570 undergo variation in current amount according to surrounding environment (high-temperature and high-humidity/low-temperature and low-humidity) and the lifespan (the number of sheets printed). That is, as the number of sheets printed increases, current amount is gradually reduced at the same applied voltage, which results in reduced charge quantity Q and increased toner amount M at the developer roller 530. In this way, it will be appreciated that the magnitude of current flowing through the developer cartridge 500 may represent the state of toner and the lifespan of the developer cartridge 500.

Accordingly, in the image forming apparatus 1 according to an embodiment, by variably controlling a voltage biased to the developer cartridge 500 based on the magnitude of current flowing through the developer cartridge 500, voltage application in consideration of the state of toner and the lifespan of the developer cartridge 500 may be accomplished, which may minimize variation in charge quantity Q and toner amount M due to variation in surrounding environment and lifespan, thus ensuring uniform image quality.

Figure 3:
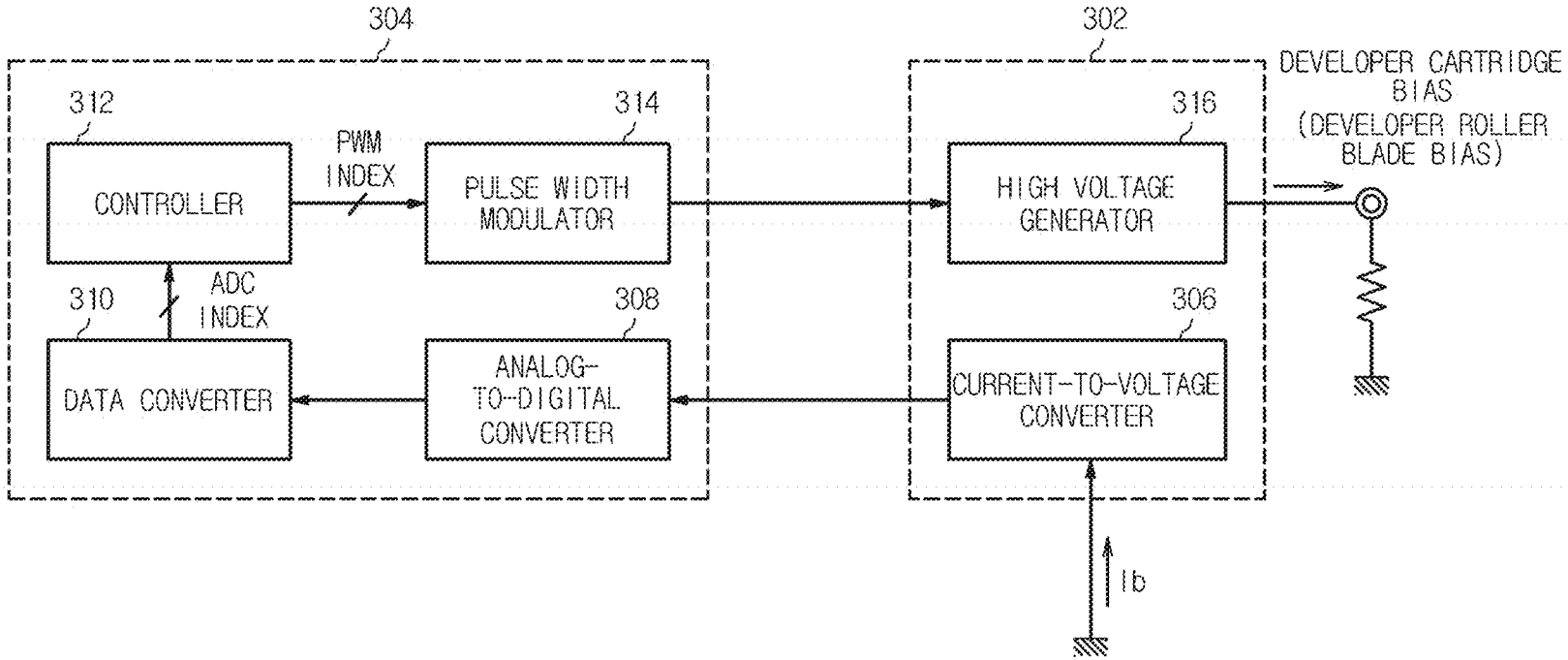
FIG. 3 is a view showing a control system of the image forming apparatus shown in FIG. 1.

FIG. 3 is a view showing a control system of the image forming apparatus shown in FIG. 1. The control system exemplarily shown in FIG. 3 consists of a high voltage power supply unit 302 and a main printed circuit board 304. The high voltage power supply unit 302 includes a current-to-voltage converter 306 and a high voltage generator 316. The main printed circuit board 304 includes an analog-to-digital converter 308, a data converter 310, a controller 312, and a pulse width modulator 314.

A procedure of adjusting developer cartridge bias (especially a developer roller blade bias) based on the magnitude of current flowing through the developer roller blade 570 will hereinafter be described with reference to FIG. 3. First, in the high voltage power supply unit 302, the current-to-voltage converter 306 converts the magnitude of current Ib flowing through the developer roller blade 570 into an analog voltage signal. That is, the current-to-voltage converter 306 generates an analog voltage signal corresponding to the magnitude of current Ib, and provides the signal to the analog-to-digital converter 308 of the main printed circuit board 304. The analog-to-digital converter 308 converts the analog voltage signal provided from the current-to-voltage converter 306 into a digital signal. The data converter 310 generates an Analog-to-Digital Conversion (ADC) index from the voltage signal digitized by the analog-to-digital converter 308, and provides the ADC index to the controller 312. The controller 312 controls general operations of the image forming apparatus 1. In particular, the controller 312 controls the quantity of power to be supplied to each component of the developer cartridge 500, thereby ensuring an appropriate level of charge in the developer cartridge 500. The controller 312 generates a pulse width modulation (PWM) index by referring to the ADC index provided from the data converter 310, and provides the PWM index to the pulse width modulator 314. The pulse width modulator 314 generates a high voltage control signal having a pulse width corresponding to the PWM index, and provides the signal to the high voltage generator 316 of the high voltage power supply unit 302. The high voltage generator 316 generates a high voltage corresponding to the pulse width of the high voltage control signal provided from the pulse width modulator 314, and outputs the voltage as a developer roller blade bias, which is one of the cartridge biases. The developer roller blade bias output from the high voltage generator 316 determines the magnitude of current to be supplied to the developer roller blade 570. If the magnitude of current flowing through the developer roller blade 570 is less than an appropriate level due to variation in surrounding environment or increase in the number of sheets printed, the controller 312 increases the pulse width of the high voltage control signal via adjustment of the PWM index, thereby increasing the magnitude of a developer roller blade bias output from the high voltage generator 316. This increases the amount of current flowing through the developer roller blade 570. Conversely, if the magnitude of current flowing through the developer roller blade 570 exceeds an appropriate level, the controller 312 reduces the pulse width of the high voltage control signal via adjustment of the PWM index, thereby reducing the magnitude of a developer roller blade bias output from the high voltage generator 316. This reduces the amount of current flowing through the developer roller blade 570.

The appropriate magnitude of current may refer to a reference value that is determined on the basis of an initial normal state of the image forming apparatus 1. That is, the magnitude of current flowing through the developer cartridge 500 in a general surrounding environment, rather than a high-temperature and high-humidity environment or low-temperature and low-humidity environment under the assumption that the number of sheets printed is zero or almost zero may be set to the reference value representing the appropriate magnitude of current.

FIG. 4 is a view showing a table for compensation of the developer cartridge bias. With reference to the table, biases of the developer roller blade 570 and the supply roller 560 may be compensated, and additionally a bias of the developer roller 530 and the charge roller 520 may be compensated.

In FIG. 4, "Measured Value" is a measured value of the magnitude of current flowing through the developer roller blade 530, and "Reference Value" has been described above with reference to FIG. 3. Once <Measured Value−Reference Value> is acquired, the controller 312 acquires a voltage compensation corresponding to the <Measured Value−Reference Value>, and calculates a PWM compensation corresponding to the voltage compensation, thereby generating a PWM index. The PWM index generated by the controller 312 determines the magnitude of a developer roller blade bias as described above with reference to FIG. 3.

Figure 5:
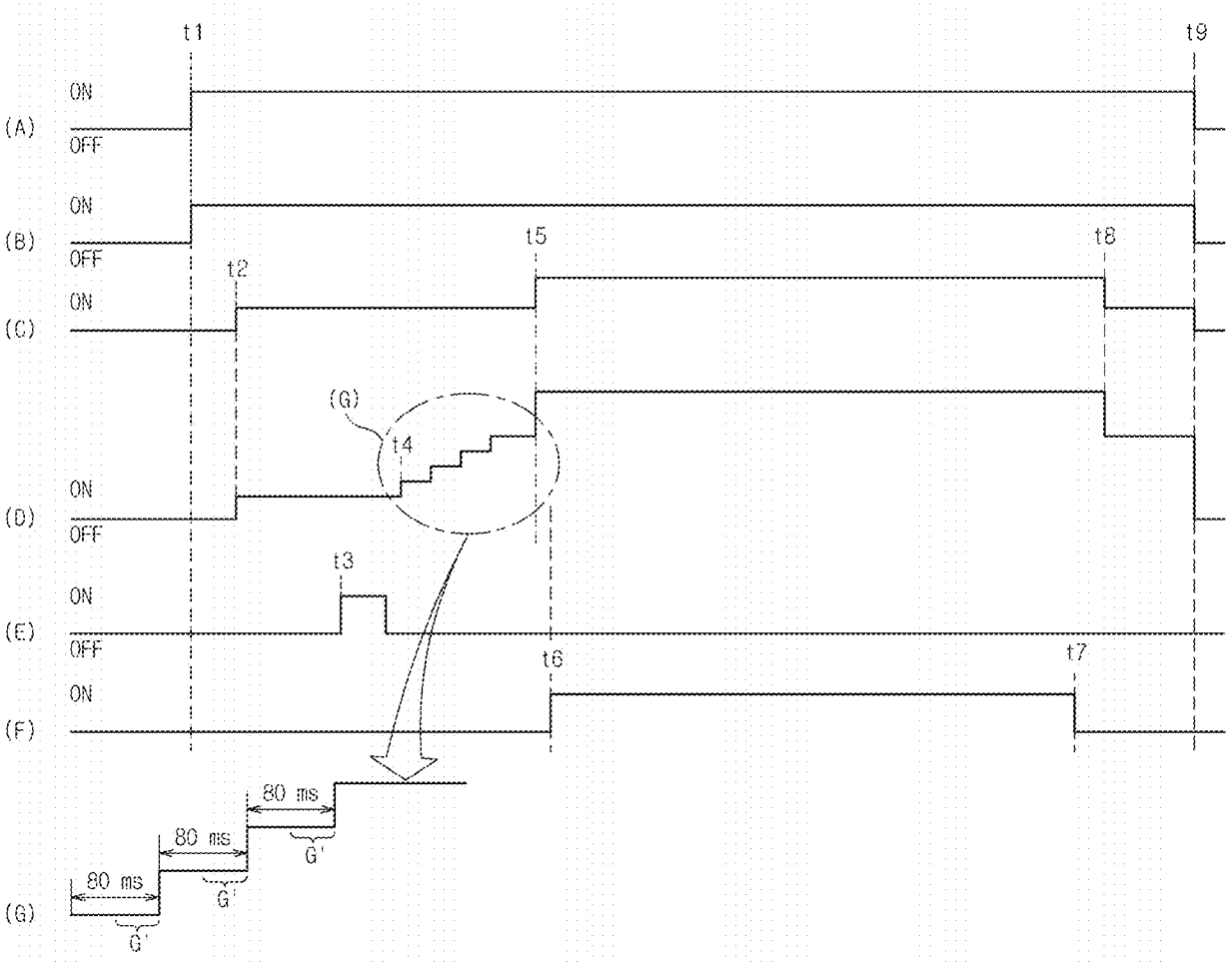
FIG. 5 is a timing chart showing operation properties of the image forming apparatus according to an embodiment.

FIG. 5 is a timing chart showing operation properties of the image forming apparatus according to an embodiment. In the following description with reference to (A) to (G) of FIG. 5, illustration of a main motor, a pickup clutch, and a paper detection sensor is omitted in the drawings.

In FIG. 5, (A) represents the operation timing of a main motor of the image forming apparatus 1. The main motor may serve to rotate the supply roller 560, the developer roller 530, the photoconductor 300, the charge roller 520, and the transfer roller 600 of the image forming apparatus 1. The supply roller 560, the developer roller 530, the photoconductor 300, the charge roller 520, and the transfer roller 600 are rotated at a predetermined speed upon receiving rotation power from the main motor through a plurality of gears, etc. Thus, operation is initiated at a starting time t1 of the main motor.

In FIG. 5, (B) represents the charge timing of the charge roller 520. The charge roller 520 initiates charge at the starting time t1 of the main motor.

In FIG. 5, (C) represents a bias of the developer roller 530. The developer roller 530 is primarily turned on at a time t2, which has slightly passed from the time t1, upon receiving a lower level of voltage than a target voltage, and at a later time t5, the target voltage is applied to the developer roller 530.

In FIG. 5, (D) represents a bias of the developer roller blade 570. Similar to the bias of the developer roller 530, a lower level of voltage than a target voltage is primarily applied to the developer roller blade 570 at the time t2. Then, after a current detection period G has passed, the target voltage is applied to the developer roller blade 570 at a time t5. A current detection bias applied to the developer roller blade 570 for the current detection period G has a plurality of voltage levels, each of which is determined based on the magnitude of a PWM index (see FIG. 6). The current detection period G will be described later.

In FIG. 5, (E) represents the operation timing of a pickup clutch. The pickup clutch serves to initiate delivery of the paper 102 stored in the paper feed unit 200. The pickup clutch initiates operation at a time t3 to deliver the paper 102 from the paper feed unit 200.

In FIG. 5, (F) represents the operation timing of a paper detection sensor. The paper detection sensor generates a paper detection signal, as exemplarily shown in (F), at a time t6 at which the paper 102 delivered from the paper feed unit 200 reaches the sensor. The generation time t6 of the paper detection signal may need to be later than the time t5 at which the target voltage is applied to the developer roller 530 and the developer roller blade 570. That is, the paper 102 may not reach an image forming position until a normal target voltage is applied to the developer roller 530 and the developer roller blade 570 to prepare for image formation.

In FIG. 5, (G) represents current detection depending on the bias of the developer roller blade 570. That is, the magnitude of current flowing through the developer roller blade 570 is detected when a current detection bias is applied to the developer roller blade 570 for a preset period (for example, 80 msec) at each of a plurality of trigger times after the supply of paper 102 has begun. A value, acquired by subtracting the magnitude of current detected for a predetermined first part of the time from the magnitude of current detected at the developer roller blade 570 at each of the plurality of trigger times and calculating the average of the magnitude of current for the last part of the time, is utilized as a representative value of the magnitude of current applied to the developer roller blade 570. For example, when a current detection bias is applied to enable flow of current to the developer roller blade 570 for 80 msec at one trigger time, current values detected for the first 40 msec are neglected and only current values detected for the last 40 msec designated by G' in (G) of FIG. 5 are utilized. This procedure is performed plural times (three times in FIG. 5), and the acquired average value is utilized as a current value of the developer roller blade 570. This serves to prevent a detection error due to voltage variation (overshoot, etc.) that may occur at the initial application of the current detection bias. The detected current value of the developer roller blade 570 is the "measured value" as described above with reference to FIG. 4. The controller 312 acquires <Measured Value−Reference Value> from the current value (measured value), acquires a voltage compensation corresponding to the <Measured Value−Reference Value>, and calculates a PWM compensation corresponding to the voltage compensation to generate a PWM index, thereby determining the magnitude of a developer roller blade bias. The application of current detection bias to the developer roller blade 570 is based on a previously stored current detection bias table (see FIG. 6).

Thereafter, if formation of an image on the paper 102 is completed at a time t7, a voltage level of the developer roller 530 and the developer roller blade 570 is lowered at a time t8, and operations of the main motor, the supply roller 560, the developer roller 530, the photoconductor 300, the charge roller 520, and the transfer roller 600 stop at a time t9. In this way, an image forming operation with respect to one sheet of the paper 102 ends.

FIG. 6 is a view showing a table for current detection bias of the image forming apparatus according to an embodiment. As exemplarily shown in FIG. 6, the current detection bias table defines a relationship between a current detection bias level, a representative current value corresponding to the current detection bias level, and a determination index. The controller 312, as exemplarily shown in FIG. 6, applies a current detection bias to the developer roller blade 570 with reference to the current detection bias table, and detects a value of current applied to the developer roller blade 570.

Figure 7:
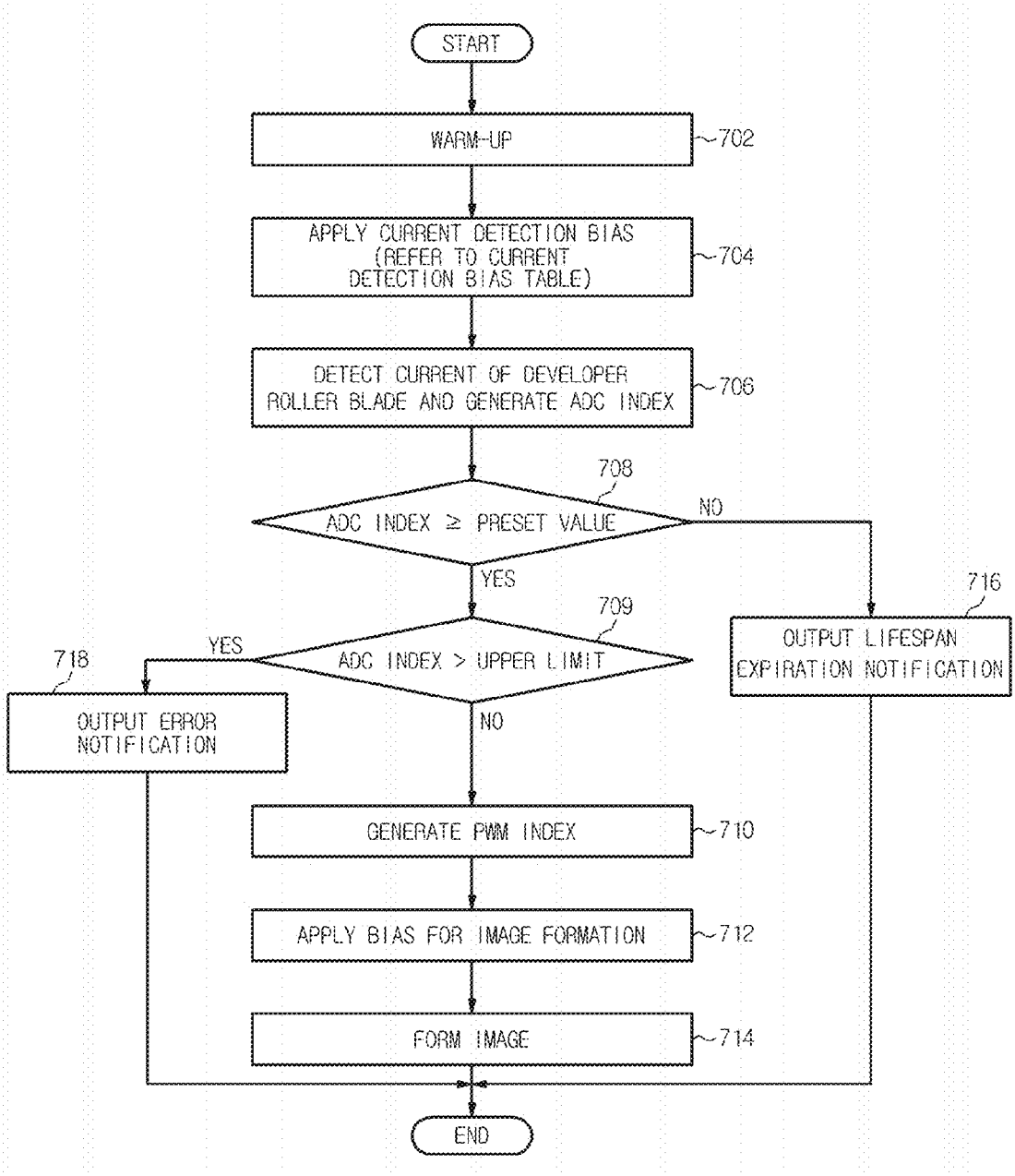
FIG. 7 is a view showing a control method for the image forming apparatus according to an embodiment.

FIG. 7 is a view showing a control method for the image forming apparatus according to an embodiment. As exemplarily shown in FIG. 7, if the controller 312 generates an instruction to initiate an image forming operation in a state in which power is supplied to the image forming apparatus 1, the main motor is started, and the paper feed unit 200, the photoconductor 300, the light scanning unit 400, the developer cartridge 500, the transfer roller 600, and the fixing unit 700 are warmed up upon receiving power (702). For reference, delivery of the paper 102 from the paper feed unit 200 is performed during warm-up. While the warm-up of the image forming apparatus 1 and the delivery of the paper 102 are performed, a current detection bias is applied to the developer roller blade 570 to detect current of the developer roller blade 570 (704). In this case, the controller 312 determines the magnitude of the applied current detection bias with reference to the current detection bias table (see (G) in FIG. 5 and FIG. 6). The controller 312 detects the magnitude of current of the developer roller blade 570, and generates an ADC index corresponding to the detected magnitude of current (706). The controller 312 compares the ADC index with a preset value (708). The preset value for comparison with the ADC index may be used to verify whether or not the lifespan of the developer cartridge 500 has expired. If the magnitude of the ADC index is equal to or greater than the preset value ("Yes" in Operation 708) and the ADC index is not greater than an upper limit ("No" in Operation 709), a PWM index, which is used to determine the magnitude of the developer roller blade bias voltage to be applied to the developer roller blade 570 during a developing operation, is generated (710). The pulse width modulator 314 generates a pulse signal, the magnitude of which corresponds to the PWM index for actual image formation, and transmits the pulse signal to the high voltage generator 316. The high voltage generator 316 generates a developer roller blade bias voltage, the magnitude of which corresponds to the transmitted pulse signal, and applies the developer roller blade bias voltage to the developer roller blade 570 (712). In this case, a voltage to be applied to other components of the developer cartridge 500 except for the developer roller blade 570, as well as the photoconductor 300, the light scanning unit 400, the transfer roller 600, and the fixing unit 700 may also vary in consideration of the magnitude of the developer bias voltage applied to the developer roller blade 570. For example, if the detected magnitude of current of the developer roller blade 570 is lower than the magnitude of current detected upon initial use (i.e. immediately after sale), the developer roller blade bias voltage of the developer roller blade 570 is increased, and a bias voltage to be applied to other components of the developer cartridge 500 except for the developer roller blade 570 as well as the photoconductor 300, the light scanning unit 400, the transfer roller 600, and the fixing unit 700, may be variably controlled so as to be increased or reduced to follow an increase or reduction in the developer roller blade bias voltage of the developer roller blade 570. In this case, variable control of the bias voltage serves to increase or reduce the developer roller blade bias voltage so as to achieve a high quality image having no abnormalities and optimized consumption of the toner 10 as developer. As the paper 102 is delivered while the bias voltage for image formation is applied, an image is formed on a surface of the paper 102 under control of the controller 312 (714).

As shown in FIG. 7, if the magnitude of ADC index is less than the preset value ("No" in Operation 708), the controller 312 determines that the lifespan of the developer cartridge 500 has expired and outputs a lifespan expiration notification (716). The user of the image forming apparatus 1 who recognizes expiration of the lifespan of the developer cartridge 500 based on the lifespan expiration notification may replace the developer cartridge 500.

As shown in FIG. 7, if the ADC index is greater than the upper limit ("YES" in Operation 709), then an error notification indicating a developer cartridge malfunction is output in Operation 718. The user of the image forming apparatus 1 who recognizes the error notification may replace the developer cartridge 500.

Figure 8:
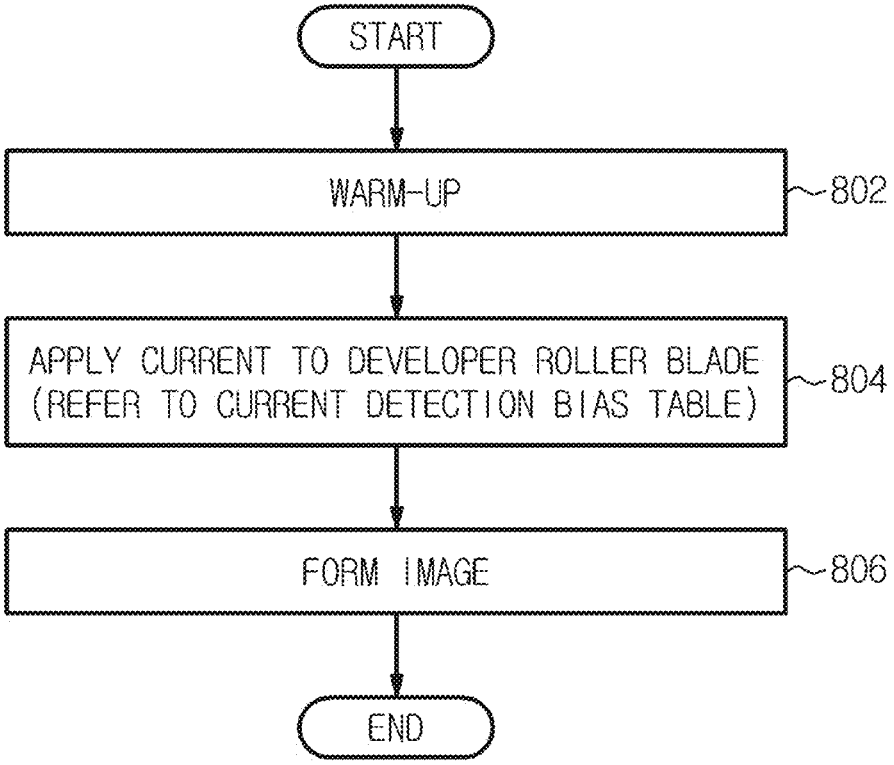
FIG. 8 is a view showing another control method for the image forming apparatus according to an embodiment.

FIG. 8 is a view showing another control method for the image forming apparatus according to an embodiment. As exemplarily shown in FIG. 8, if the controller 312 generates an instruction to initiate an image forming operation in a state in which power is supplied to the image forming apparatus 1, the main motor is started, and the paper feed unit 200, the photoconductor 300, the light scanning unit 400, the developer cartridge 500, the transfer roller 600, and the fixing unit are warmed up upon receiving power (802). For reference, delivery of the paper 102 from the paper feed unit 200 is performed during warm-up. While the warm-up of the image forming apparatus 1 and the delivery of the paper 102 are performed, current for actual image formation is applied to the developer roller blade 570 (804). In this case, the controller 312 determines the magnitude of current to be applied for image formation with reference to a previously stored developer roller blade current table. The developer roller blade current table may define the magnitude of current to be applied to the developer roller blade 570 under conditions of the particular number of sheets printed and a particular environment in consideration of lifespan (the number of sheets printed) and surrounding environment. The developer roller blade current table is provided to vary a developer roller blade bias voltage to ensure that a constant current is applied to the developer roller blade 570. As exemplarily shown in FIG. 8, controlling application of constant current to the developer roller blade 570 may omit the aforementioned current detection and developer roller blade bias voltage control as described in the control method of FIG. 7, which results in relatively simplified current control with regard to the developer roller blade 570 for image formation. As the paper 102 is delivered while the developer bias voltage for image formation is applied, an image is formed on a surface of the paper 102 under control of the controller 312 (806).

Figure 9:
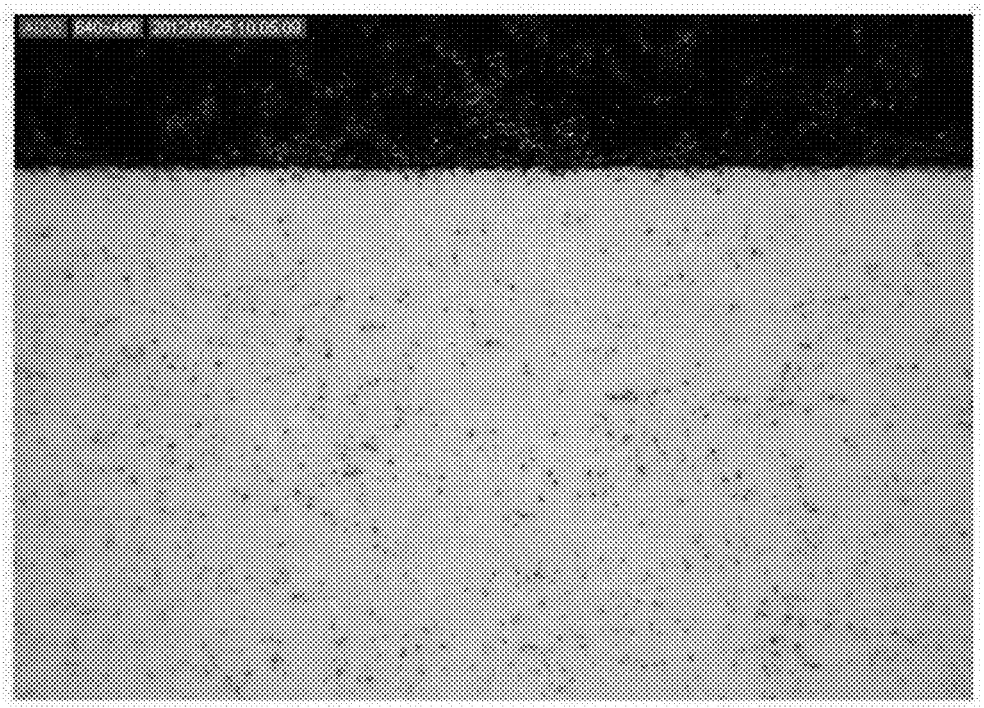
FIG. 9 is a view for image quality comparison of the image forming apparatus according to an embodiment.
Figure 9:
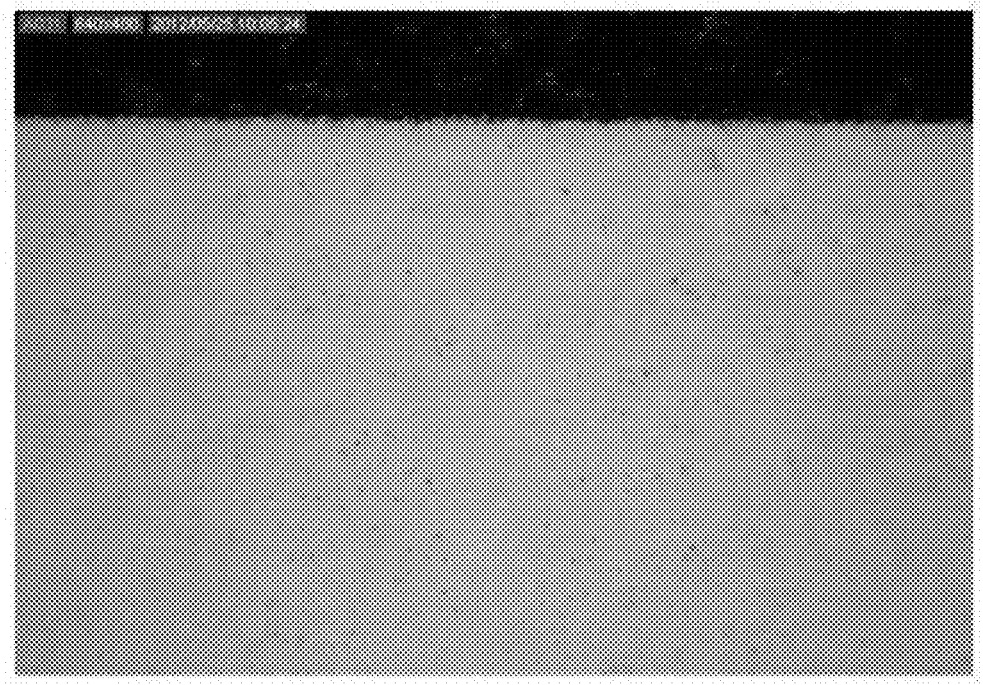

FIG. 9 is a view for comparison of image quality of the image forming apparatus according to an embodiment. In particular, FIGS. 9A and 9B show printed results of a test pattern having a "T"-shape to confirm printing quality. More specifically, FIG. 9A shows an image formed when not performing current control of the developer roller blade 570 according to an embodiment, and FIG. 9B shows an image formed when performing current control of the developer roller blade 570 according to an embodiment. As will be appreciated, in FIG. 9A, a formed image is not clear because a great amount of toner causes the aforementioned background phenomenon at a rear end of the T-shaped test pattern. On the other hand, in FIG. 9B, owing to current control of the developer roller blade 570 according to AN embodiment, a more clear image than that of FIG. 9A is formed because only a small amount of toner causes the aforementioned background phenomenon at a rear end of the T-shaped test pattern. The background phenomenon has been described above in detail with reference to FIGS. 2A and 2B.

As is apparent from the above description, according to embodiments, by controlling physical-states (toner amount and charge quantity) of toner on a developer roller based on sensed variation in states of internal components of a developer cartridge, such as the developer roller, a developer roller blade and a supply roller, etc, a high quality image may be acquired. Further, sensing and determining the lifespan of the developer cartridge may be possible.

Although embodiments have been shown and described, it would be appreciated by those skilled in the art that changes may be made in these embodiments without departing from the principles and spirit of the disclosure, the scope of which is defined in the claims and their equivalents.

What is claimed is:

1. A control method for an image forming apparatus, the method comprising:

applying a current detection bias to a developer roller blade of a developer cartridge;

detecting the magnitude of current flowing through the developer roller blade when the current detection bias is applied to the developer roller blade; and variably controlling a developer cartridge bias to be applied to the developer cartridge for image formation based on the detected magnitude of current of the developer roller blade, so as to allow a target magnitude of constant current to flow through the developer roller blade during image formation, wherein the current detection is performed at a plurality of trigger times to acquire a plurality of current values, and the average of the plurality of current values is utilized as a representative value of the magnitude of current of the developer roller blade, and wherein the magnitude of current detection bias is determined with reference to a previously stored current detection bias table that defines a relationship between a Pulse Width Modulation index which represents a current detection bias level and an Analog-to-Digital Conversion index which provides a representative current value corresponding to the current detection bias level.

2. The method according to claim 1, wherein:

the magnitude of current flowing through the developer roller blade is detected while the current detection bias is applied to the developer roller blade for a preset time.

3. The method according to claim 2, wherein the magnitude of current detected for a predetermined first part of the preset time is neglected, and only the magnitude of current detected for the last part of the preset time is utilized.

4. The method according to claim 1, further comprising:

converting the magnitude of current flowing through the developer roller blade into an analog voltage signal via a current-to-voltage converter;

converting the analog voltage signal provided by the current-to-voltage converter into a digital signal via an analog-to-digital converter;

generating the Analog-to-Digital Conversion (ADC) index from the voltage signal digitized by the analog-to-digital converter so as to provide the ADC index to a controller via a data converter;

generating a high voltage control signal having a pulse width corresponding to the Pulse Width Modulation (PWM) index via a pulse width modulator if the controller generates the PWM index with reference to the ADC index provided by the data converter; and generating a high voltage corresponding to the pulse width of the high voltage control signal provided by the pulse width modulator so as to output the high voltage as the developer cartridge bias via a high voltage generator.

5. The method according to claim 4, wherein the generation of the PWM index includes:

subtracting a preset reference value from a measured value representing the detected magnitude of current of the developer roller blade;

acquiring a voltage compensation corresponding to the subtraction result; and calculating a PWM compensation corresponding to the voltage compensation to generate the PWM index.

6. The method according to claim 4, further comprising generating the PWM index if the ADC index is equal to or greater than a preset value, thereby controlling application of the developer bias.

7. The method according to claim 6, further comprising determining that the lifespan of the developer cartridge has expired if the ADC index is less than the preset value, thereby controlling output of a lifespan expiration notification.

8. The method according to claim 6, further comprising determining that the developer cartridge malfunctions if the ADC index exceeds a preset upper limit, thereby controlling output of an error notification.

9. An image forming apparatus comprising:

a developer cartridge including a developer roller blade;

a high voltage power supply unit to apply a current detection bias and a developer cartridge bias to the developer roller blade; and a controller that detects the magnitude of current flowing through the developer roller blade when the current detection bias is applied to the developer roller blade, and variably controls a developer cartridge bias to be applied to the developer cartridge for image formation based on the detected magnitude of current of the developer roller blade, so as to allow a target magnitude of constant current to flow through the developer roller blade during image formation, wherein the controller acquires a plurality of current values by performing current detection at a plurality of trigger times, and utilizes the average of the plurality of current values as a representative value of the magnitude of current of the developer roller blade, and wherein the magnitude of current detection bias is determined with reference to a previously stored current detection bias table that defines a relationship between a pulse width modulation index which represents a current detection bias level and an analog-to-digital conversion index which provides a representative current value corresponding to the current detection bias level.

10. The apparatus according to claim 9, wherein:

the controller detects the magnitude of current flowing through the developer roller blade while the current detection bias is applied to the developer roller blade for a preset time.

11. The apparatus according to claim 10, wherein the controller neglects the magnitude of current detected for a predetermined first part of the preset time, and utilizes only the magnitude of current detected for the last part of the preset time.

12. The apparatus according to claim 9, further comprising:

a current-to-voltage converter that converts the magnitude of current applied to the developer roller blade into an analog voltage signal;

an analog-to-digital converter that converts the analog voltage signal provided by the current-to-voltage converter into a digital signal;

a data converter that generates the Analog-to-Digital Conversion (ADC) index from the voltage signal digitized by the analog-to-digital converter, and provides the ADC index to the controller;

a pulse width modulator that generates a high voltage control signal having a pulse width corresponding to the Pulse Width Modulation (PWM) index if the controller generates the PWM index with reference to the ADC index provided by the data converter; and a high voltage generator that generates a high voltage corresponding to the pulse width of the high voltage control signal provided by the pulse width modulator, and outputs the high voltage as the developer cartridge bias.

13. The apparatus according to claim 12, wherein the generation of the PWM index includes:

subtracting a preset reference value from a measured value representing the detected magnitude of current of the developer roller blade;

acquiring a voltage compensation corresponding to the subtraction result; and calculating a PWM compensation corresponding to the voltage compensation to generate the PWM index.

14. The apparatus according to claim 13, wherein the controller determines that the lifespan of the developer cartridge has expired if the ADC index is less than the preset value, thereby controlling output of a lifespan expiration notification.

15. The apparatus according to claim 12, wherein the controller generates the PWM index if the ADC index is equal to or greater than a preset value, thereby controlling application of the developer cartridge bias.

16. The apparatus according to claim 12, wherein the controller determines that the developer cartridge malfunctions if the ADC index exceeds a preset upper limit, thereby controlling output of an error notification.

* * * * *